United States Patent [19]

Coppock

[11] Patent Number: 4,540,175

[45] Date of Patent: Sep. 10, 1985

[54] GAME OF CHANCE

[76] Inventor: C. Wallace Coppock, 620 E. Washington St., Petaluma, Calif. 94952

[21] Appl. No.: 644,632

[22] Filed: Aug. 27, 1984

[51] Int. Cl.[3] ..... A63F 9/00

[52] U.S. Cl. ..... 273/139

[58] Field of Search ..... 273/139, 138, 1 R, 1 E, 273/1 G, 1 GC, DIG. 28; 283/100–102

[56] References Cited

U.S. PATENT DOCUMENTS

| | | | |
|---|---|---|---|
| 3,055,117 | 9/1962 | Bernstein et al. | 283/102 X |
| 3,212,780 | 10/1965 | Jewell | 273/139 X |
| 3,826,499 | 7/1974 | Lenkoff | 273/139 X |
| 3,918,174 | 11/1975 | Miller et al. | 283/102 X |
| 4,019,737 | 4/1977 | Witzel | 273/94 |
| 4,034,987 | 7/1977 | Kelley | 273/139 X |
| 4,141,548 | 2/1979 | Everton | 273/DIG. 28 X |
| 4,466,614 | 8/1984 | Bachman et al. | 273/139 |
| 4,491,319 | 1/1985 | Nelson | 273/139 X |

OTHER PUBLICATIONS

Kellogg's Sports Game, 1-1974.
The Great Guiness Game, 2-1983.

*Primary Examiner*—Paul E. Shapiro
*Attorney, Agent, or Firm*—Melvin R. Stidham

[57] ABSTRACT

A game of chance wherein there are several rows of spaces, say three, arranged in columns and containing symbols placed at random. All of the spaces are masked to render the symbols invisible. A symbol for the various columns is called out periodically and a player attempts to guess that space in which the symbol called out is located. A successful attempt is called a match. There is an array of further spaces, one for each row and, as the last column is uncovered there is called out a desired relative performance of matches, e.g. "most" or "least," and the player seeks to select that row in which the desired relative performance occurs, based on symbols already uncovered.

4 Claims, 4 Drawing Figures

GAME OF CHANCE

BACKGROUND OF THE INVENTION

In the television and broadcasting industries today there is a continuing and growing competition for the advertising dollar. There are several rating systems for determining the relative popularity of television programs and, it is to the interest of the various television networks to present the most popular programs in order to attract a greater listening audience and, hence, to attract advertisers to present their commercials. It is highly unlikely that a television network can maintain a level of programming over the course of a full evening that will dissuade at least a segment of the listening audience from switching to other networks. It would be of extreme value, therefore, to provide some further incentive to keep a viewer and/or listener from switching to another channel during the course of the evenings programming. Accordingly, I have invented this game of chance particularly adapted for playing in conjunction with a series of television programs as a variation of the games shown in my U.S. Pat. No. 4,429,877, granted Feb. 7, 1984, and my co-pending application Ser. No. 601,011, filed Apr. 16, 1984.

OBJECTS OF THE INVENTION

It is an object of this invention to provide a game of change that is keyed to the prime time programming of a television network and designed to keep the viewer's attention throughout an evening's programming.

It is a further object of this invention to provide a game of chance that is particularly adapted for play in conjunction with a series of television programs on a single network or station.

Other objects and advantages of this invention will become apparent from the description to follow, particularly when read in conjunction with the accompanying drawings.

SUMMARY OF THE INVENTION

In carrying out this invention, I provide a multiplicity of playing cards each of which contains three or more rows of spaces, arranged in columns, with one column for each commercial break to be presented during the television programming for a portion of the day. Within the spaces are arranged at random a plurality of signals, such as the initials of a television network. The spaces are all covered by an opaque mask so that the symbols contained therein are invisible. At each commercial break, there is presented an audible or visual signal calling out a particular symbol and each player attempts to guess the row in that column on his card in which the called signal will appear and scrapes away the mask to reveal the symbol thereunder. If he is successful in doing so, it is termed a "match." Then, toward the end of the evening's programming, and usually when the symbol for the last column is called out, a second signal relating to relative performance in successful matches is also communicated. For example, such signal may be "most" or "least."

A second array of spaces, one for each row is also masked to hide the marking therein, but underneath the masking, one of the spaces is marked to show that the particular row it represents has produced the desired performance. Hence, the selection of the proper row is not pure chance but affords the player the opportunity to analyze the spaces he has already uncovered to give him some clue as to which row may have the most or least number of matches, as indicated by the signal communicated. Hence, a player is compelled to maintain his attention to the entire evening's programming so that he can determine where matches have been made or missed during all commercial breaks to enhance his chances of guessing correctly on the final unmasking.

DESCRIPTION OF A PREFERRED EMBODIMENT

Figure 1:
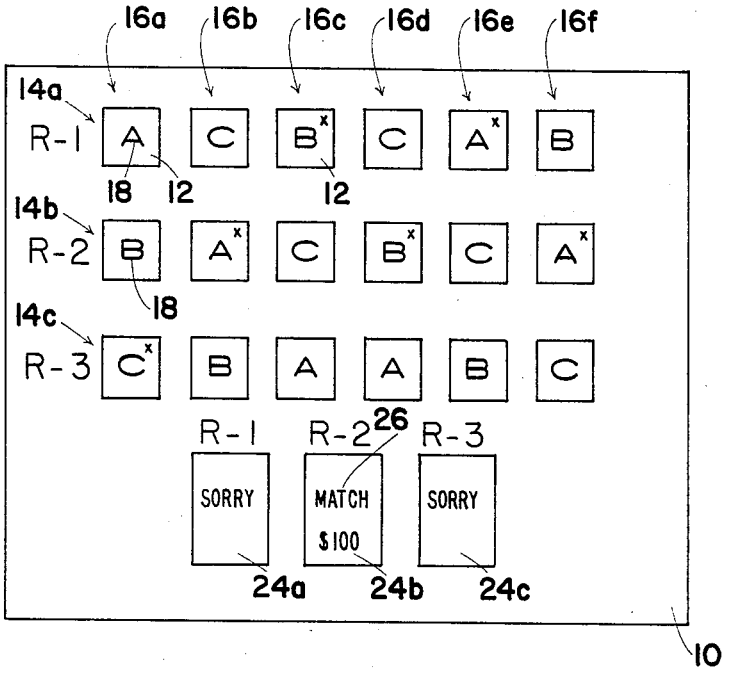
FIG. 1 is a top plan view of the game card showing rows of boxes with markings therein.

Referring now to the drawing with greater particularly, the game card 10 of this invention is marked with a plurality of spaces or boxes 12 arranged in a plurality of rows 14*a*, 14*b* and 14*c* marked R-1, R-2 and R-3, and columns 16*a* . . . 16*f*. Within the boxes are marked at random a plurality of symbols 18 one for each space in a column 16*a–f* thereof and, preferably, with different symbols in each row 14*a*, 14*b* and 14*c* of each column. It is to be understood that the terms "rows" and "columns" are here used interchangeably and that the rows 14*a*, 14*b* and 14*c* could just as well be disposed vertically.

Figure 2:
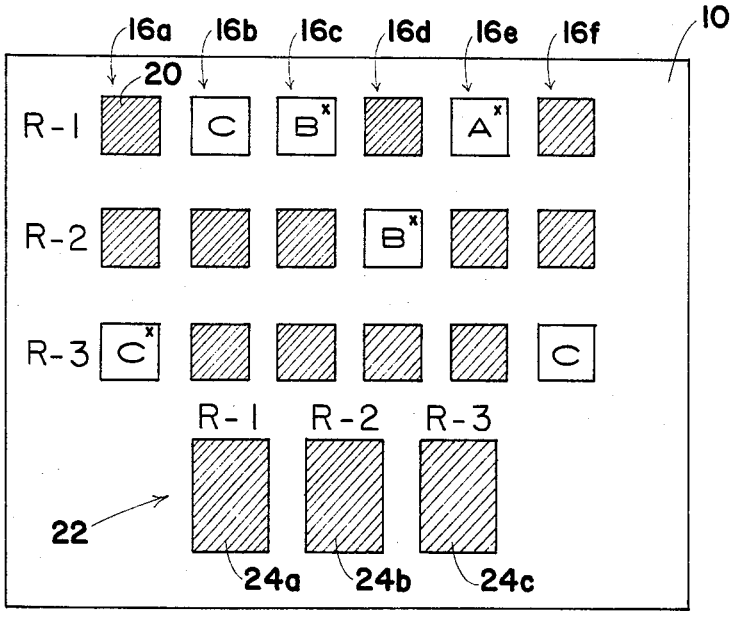
FIG. 2 is a top plan view of the game card with the spaces masked and with some of the masks removed.
Figure 2A:
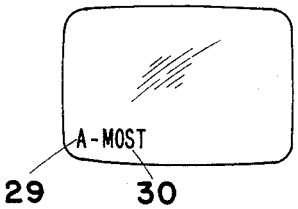

As shown specifically in FIG. 2, all of the spaces 12 are covered with an opaque mask to render the symbols therein invisible so that the particular symbol or letter appearing in a space is unknown until the mask 20 is removed. Moreover, the symbols are placed at random and not repeated in sequence in different columns so that the successful uncovering of a called symbol is purely by chance. The mask 20 may comprise a piece of opaque tape but preferably, it comprises a coating of some form of ink that can be removed by scraping or wiping away. In this way, a choice once made is irrevocable and a player is committed.

In playing the game, a symbol or letter is called out for each column at intervals and the player attempts to remove the mask 20 from the space in the appropriate column in an effort to uncover the symbol called out. A successful attempt may be called a "match."

A second array 22 of further spaces or boxes 24*a*, 24*b* and 24*c* is arranged to represent the rows 14*a*, 14*b* and 14*c* from which selections are made at random. As shown in FIG. 1, at least one of these spaces 24*b* contains a success marking 26 showing that that particular row, r-2, has a desired performance of matches. It may also include a prize marking 28 to inform the player of his award. The other spaces may be marked to show failure or simply left blank. The further spaces 24*a*, 24*b* and 24*c* are also covered with opaque masks 26 so that any markings contained therein are hidden until uncovered.

Figure 1A:
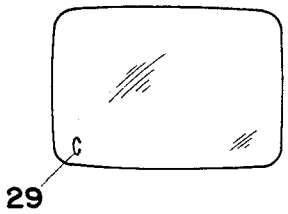
FIGS. 1A and 2A show television screens with symbols communicated visually.

As previously mentioned, this game is particularly adapted for play in conjunction with a series of programs such as the prime time in the evening. For example, with prime time beginning at eight o'clock p.m., there may be a commercial break at, say, eight-twenty p.m. At sometime during that commercial break there is a visual or audible signal calling out a certain symbol to be matched. As shown in FIG. 1A, a visual signal 29, in this case "C" may be called out during the first commercial break represented by the column 16*a* and the player will attempt to uncover that space in the column 16*a* in which the symbol "C" is shown. Where the player is successful in uncovering the called symbol he may place a mark in the box to show a successful match.

This procedure is repeated throughout the evening's broadcast with a symbol being called out during each commercial break. Finally, toward the end of the evening's broadcasting, and, preferably, at the last commercial break, a second signal 30 is called out or shown visually to indicate the desired performance of matches. For example, the signal could be "most" or "least." Then, assuming the signal "most" is called out, the player may then analyze his card to attempt to guess at the row in which the most matches have been made. In the card shown in FIG. 2, two matches have been made in row R-1; one match has been made in row R-2 and one match has been made in row R-3, after uncovering the last column 16*f*. Hence, the player could very easily believe that row R-1 contains the most matches and, therefore, would be induced to uncover the further square 24*a* representing the row R-1. As shown in FIG. 1, this would result in failure to make a match. Having already lost in the big prize, the player may then scratch away the mask 26 or 24*b* and 24*c* to determine what he might have won.

While this invention has been described in conjunction with a preferred embodiment thereof, it is obvious that modifications and changes therein may be made by those skilled in the art to which it pertains without departing from the spirit and scope of this invention, as defined by the claims appended hereto.

What is claimed as invention is:

1. A game of chance comprising:

a game card for each player having delineated thereon a plurality of rows of first spaces arranged in columns;

a plurality of symbols, one marked at random in each first space of a column thereof;

a removable mask covering each of said first spaces to render a symbol therein invisible;

one mask in a column thereof being removable by the player in an attempt to uncover that symbol which is called out;

a successful attempt being deemed a match;

a group of further spaces equal in number to the number of said rows of first spaces;

an identification mark adjacent each of said further spaces, each to represent one of said rows;

a success marking in the further space representing that one of said rows in which occur the desired relative number of matches; and a removable mask covering each of said further spaces to render a success marking therein invisible so that a player may unmask one of said further spaces in an attempt to uncover the success masking based on symbols in said first spaces previously unmasked.

2. The game of chance defined by claim 1 wherein:

the success marking is in that further space that represents that one of said rows in which occur the most matches.

3. The game of chance defined by claim 1 wherein the success marking is in that further space representing the row in which occurs the least number of matches.

4. The game of chance defined by claim 1 wherein:

a symbol to be uncovered is called out during commercial breaks of a television program; and the desired relative number of matches is called out when the symbol for the last column is called out so that the player may choose the further space to be unmasked based on all first spaces previously unmasked.

* * * * *